US010446964B2

(12) United States Patent
Chen

(10) Patent No.: US 10,446,964 B2
(45) Date of Patent: Oct. 15, 2019

(54) HIGH DENSITY CONNECTOR AND WAFER GROUP

(71) Applicant: OUPIIN ELECTRONIC (KUNSHAN) CO., LTD., Kunshan (CN)

(72) Inventor: Hsin Chih Chen, Kunshan (CN)

(73) Assignee: OUPIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 16/181,398

(22) Filed: Nov. 6, 2018

(65) Prior Publication Data

US 2019/0207336 A1 Jul. 4, 2019

(30) Foreign Application Priority Data

Jan. 2, 2018 (CN) ..... 2018 1 0001975
Jan. 2, 2018 (CN) ..... 2018 2 0002042 U

(51) Int. Cl.

| | |
|---|---|
| ***H01R 13/648*** | (2006.01) |
| ***H01R 13/20*** | (2006.01) |
| ***H01R 13/631*** | (2006.01) |
| ***H01R 13/6471*** | (2011.01) |
| ***H01R 13/502*** | (2006.01) |
| ***H01R 13/627*** | (2006.01) |
| ***H01R 12/72*** | (2011.01) |

(52) U.S. Cl.

CPC ..... *H01R 13/20* (2013.01); *H01R 12/721* (2013.01); *H01R 13/502* (2013.01); *H01R 13/6272* (2013.01); *H01R 13/631* (2013.01); *H01R 13/6471* (2013.01)

(58) Field of Classification Search

CPC .... H01R 13/20; H01R 13/502; H01R 13/631; H01R 13/6272; H01R 13/6471; H01R 12/721

USPC ..... 439/329, 607.06, 607.39, 660, 701

See application file for complete search history.

(56) References Cited

U.S. PATENT DOCUMENTS

| | | | | |
|---|---|---|---|---|
| 6,293,827 | B1 * | 9/2001 | Stokoe | H01R 13/514 439/108 |
| 6,517,360 | B1 * | 2/2003 | Cohen | H01R 23/688 439/607.11 |
| 2003/0181077 | A1 * | 9/2003 | Rothermel | H01R 13/6471 439/76.1 |
| 2013/0217263 | A1 * | 8/2013 | Pan | H01R 13/6474 439/607.07 |
| 2016/0093985 | A1 * | 3/2016 | Zhang | H01R 13/6586 439/607.07 |

* cited by examiner

*Primary Examiner* — Khiem M Nguyen
(74) *Attorney, Agent, or Firm* — Mark M. Friedman

(57) ABSTRACT

A high density connector and a wafer group are disclosed in this invention. The high density connector includes an insulating housing, which forms a guide bracket to provide a guiding and locking function for a plug connector. The wafer group includes two signal wafers and a grounding wafer, which are adjacent to be arranged. The two adjacent signal wafers make up a group. Signal terminals of the two adjacent signal wafers can form multiple differential pairs in an edge-coupled manner, thereby reducing the loss of signal transmission and improving the quality of differential signal transmission.

10 Claims, 17 Drawing Sheets

HIGH DENSITY CONNECTOR AND WAFER GROUP

BACKGROUND OF THE INVENTION

1. Field of the Invention

The present invention relates to a connector technology, and more particularly to a high density connector and a wafer group; wherein the high density connector includes an insulating housing being provided with a guide bracket for guiding and locking a plug connector; and the wafer group includes multiple pairs of differential signal terminals being arranged in an edge-coupled manner for reducing the loss of signal transmission and improving the quality of differential signal transmission.

2. Description of the Prior Art

At present, connectors are developing towards high performance and high density. For example, a Mini SAS HD (high density) connector is a high density interface, and it has the advantages of small size, wider bandwidth, larger capacity and faster data transmission. So it is mainly used in a large server, a high-speed network server and a network storage device.

But the high performance and high-density connector can cause problems, such as reducing the electrical isolation due to more dense terminals, and reducing signal levels. In the prior art, this type of connector must set a separate guide bracket to ensure the exact docking of a plug connector to the socket connector.

Hence, the applicant wants to improve the electrical performance of the connector by changing the terminal structure, and improve the usability of the connector by designing the guide bracket.

BRIEF SUMMARY OF THE INVENTION

A primary object of the present invention is to provide a high density connector, which can guide and lock a plug connector by a guide bracket formed on an insulating housing, and which can provide multiple pairs of differential signal terminals arranged in an edge-coupled manner for reducing the loss of signal transmission and improving the quality of differential signal transmission.

The other object of the present invention is to provide a wafer group, which includes two signal wafers and one ground wafer being arranged in a signal-signal-ground mode, and further includes multiple pairs of differential signal terminals arranged in an edge-coupled manner for reducing the loss of signal transmission and improving the quality of differential signal transmission, and further realizing the function of electromagnetic shielding by a ground wafer.

Other objects and advantages of the present invention may be further understood from the technical features disclosed by the present invention.

To achieve the aforementioned object or other objects of the present invention, the present invention adopts the following technical solution.

The present invention provides a high density connector, which comprises an insulating housing and a wafer module. The insulating housing has a base, a docking portion extending forward from the front of the base, and a guide bracket being formed on the top of the base and extending forward above the docking portion. The base forms a cavity. The docking portion has at least one electronic card receiving slot formed on the front thereof and two rows of terminal receiving grooves arranged on two opposite sides of the electronic card receiving slot respectively. All the terminal receiving grooves are communicated with the cavity. The wafer module is mounted in the cavity of the insulating housing and is assembled by multiple wafer groups arranged side by side. Each wafer group includes a first wafer, a second wafer and a third wafer, which are arranged side by side in this order. The first and second wafers are signal wafers for supporting multiple signal terminals. The third wafer is a ground wafer for supporting at least one ground terminal. Wherein the wafer module is configured in a repetitive mode with "signal wafer"-"signal wafer"-"ground wafer", every two adjacent signal wafers form a pair of signal wafers, and the signal terminals of the two adjacent signal wafers form multiple edge-coupled differential pairs.

In one embodiment, the guide bracket has a horizontal portion being provided with a locking structure and two vertical portions being symmetrically located on both sides of the horizontal portion; the rear of the horizontal portion is connected to the top of the base; the front of the horizontal portion is located above the docking portion; and the horizontal portion and the two vertical portions together define a guide space above the docking portion.

In one embodiment, the insulating housing further includes two support portions, which are symmetrically located on two sides of the base and extend vertically to the bottom of the base; the two support portions are located under the two vertical portions; and each support portion forms a hole on the bottom thereof.

The present invention provides a wafer group, comprising a first wafer, a second wafer and a third wafer. The first wafer is a signal wafer, which includes a first frame and multiple first signal terminals supported by the first frame. Each first signal terminal has a first signal tail extending out from a first edge of the first frame, a first signal contact portion extending out from a second edge of the first frame, and a first middle portion being located between the first signal tail and the first signal contact portion. The second wafer is a signal wafer, which includes a second frame and multiple second signal terminals supported by the second frame. Each second signal terminal has a second signal tail extending out from a first edge of the second frame, a second signal contact portion extending out from a second edge of the second frame, and a second middle portion being located between the second signal tail and the second signal contact portion. The third wafer is a ground wafer, which includes a third frame and at least one ground terminal supported by the third frame. The ground terminal has a row of ground tails extending out from the bottom of the third frame, a row of ground contact portions extending out from the side of the third frame, and a ground main body between the ground tails and the ground contact portions. The ground main body is located on one side of the second wafer to cover the first and second middle portions in the first and second wafers. Wherein the first wafer, the second wafer and the third wafer are arranged side by side in this order; the first middle portions of the first signal terminals and the second middle portions of the second signal terminals are located in one vertical plane and exposed to the air; and each second middle portion is coupled with the corresponding first middle portion in an edge-coupled manner to make the second signal terminal and the corresponding first signal terminal form one edge-coupled differential pair.

In one embodiment, in each differential pair, at least one of the first and second signal contact portions is out of the vertical plane, and the first and second signal contact portions are arranged in parallel and form a wide side to wide side mode; and at least one of the first and second signal tails is out of the vertical plane, and the first and second signal tails are arranged in a staggered manner and are not coplanar or coaxial.

In one embodiment, each first signal terminal further includes one head-adjusting structure and one tail-adjusting structure, the head-adjusting structure is located between the first middle portion and the first signal contact portion to change the relative position of the first signal contact portion and the first middle portion and to make the first signal contact portion be out of the vertical plane of the first middle portion; and the tail-adjusting structure is located between the first middle portion and the first signal tail to change the relative position of the first signal tail and the first middle portion and to make the first signal tail be out of the vertical plane of the first middle portion; and each second signal terminal also includes one head-adjusting structure located between the second middle portion and the second signal contact portion and one tail-adjusting structure located between the second middle portion and the second signal tail.

In comparison with the prior art, the high density connector of the present invention can provide a guiding and locking function for the plug connector by the guide bracket formed on the insulating housing. Further, the high density connector of the present invention includes multiple pairs of differential signal terminals arranged in an edge-coupled manner for reducing the loss of signal transmission and improving the quality of differential signal transmission. The wafer group of the present invention includes multiple pairs of differential signal terminals, each of which has the middle portion exposed outside. The middle portions on each pair of differential signal terminals can realize the edge coupling through air to reduce the loss of signal transmission and improve the quality of differential signal transmission.

and

Figure 19:
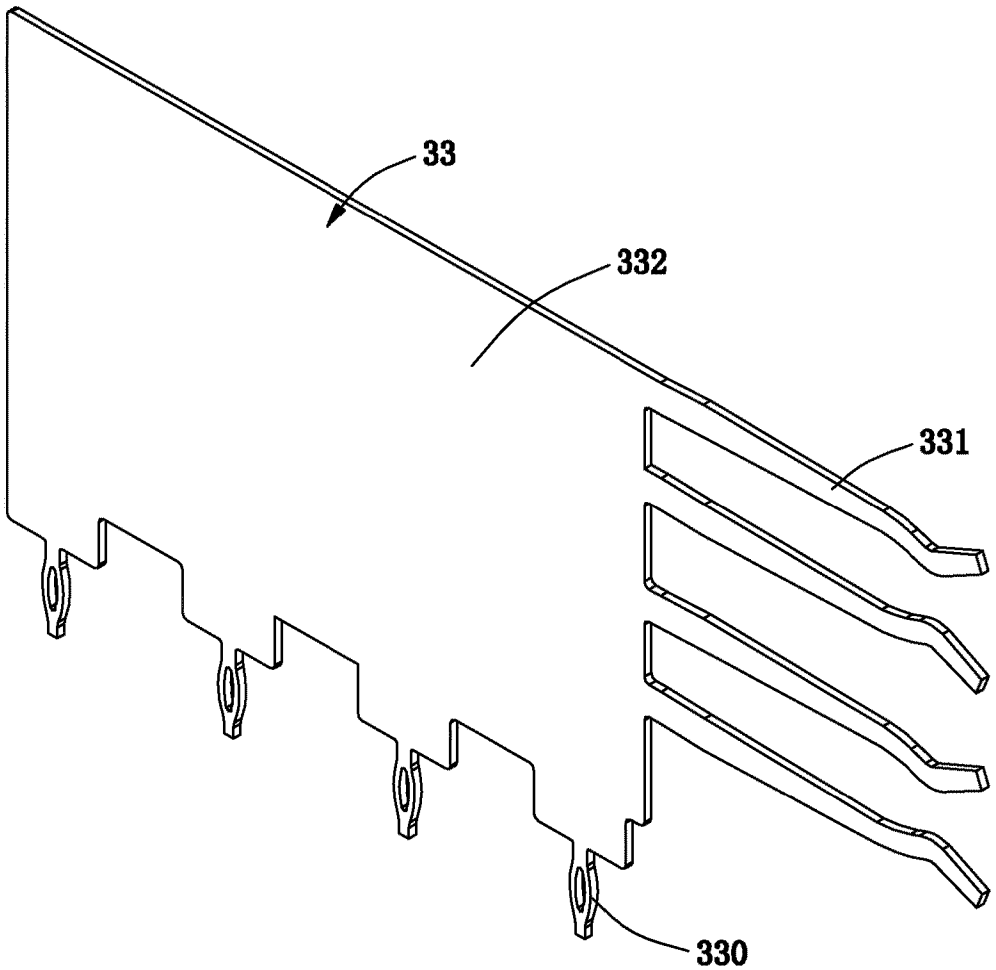

FIG. 19 is a schematic view of a ground terminal of the present invention.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Please refer to FIGS. 1 to 4, a high density connector 1 of the present invention is a right-angle connector, the mating direction of which is parallel to a circuit board 2. In other embodiments, the high density connector 1 of the present invention may be mounted at other angles on the circuit board 2. For example, the high density connector 1 may be a vertical connector, the mating direction of which is perpendicular to the circuit board 2.

Figure 5:
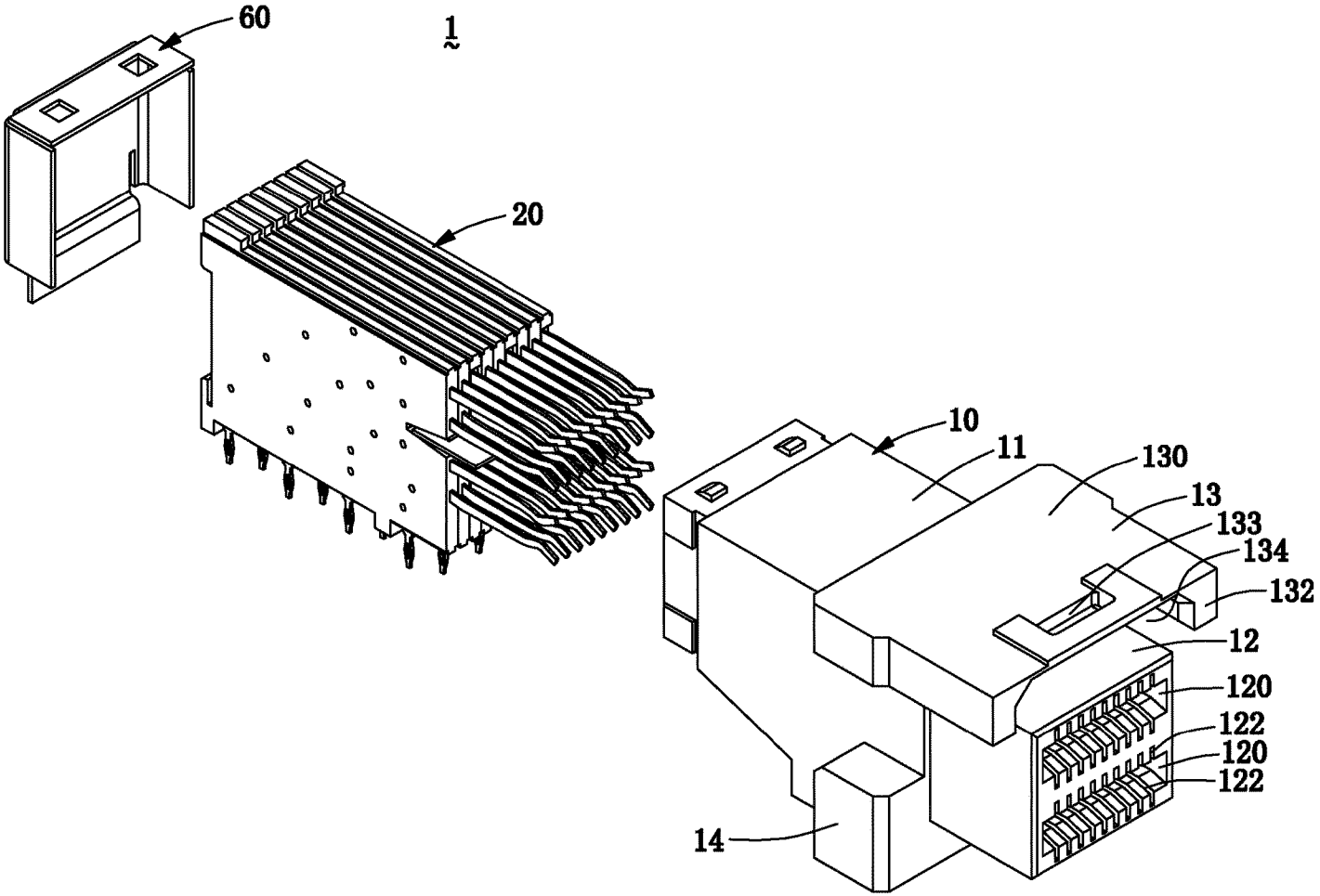
FIG. 5 is an exploded view of the high density connector of the present invention.
Figure 6:
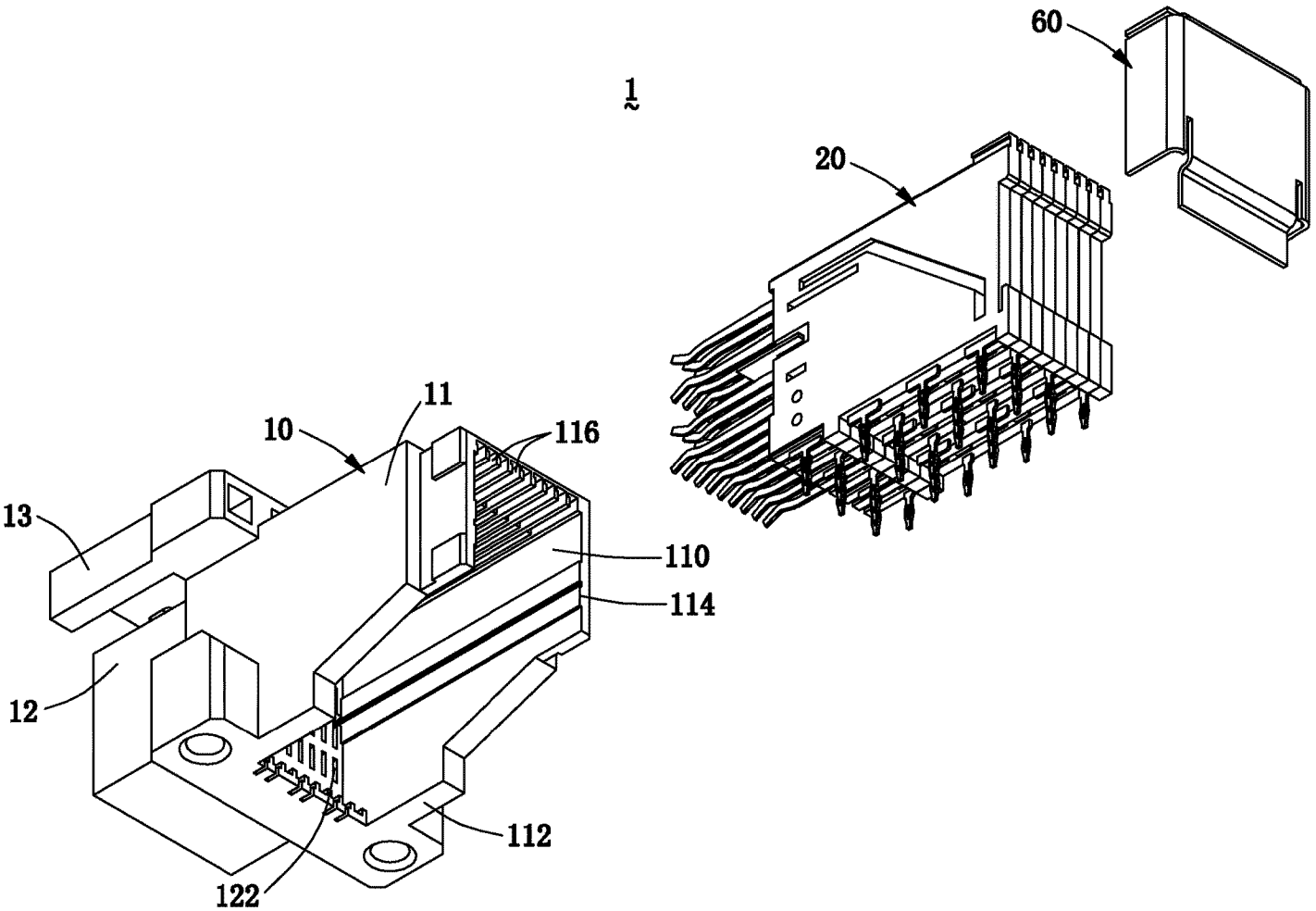
FIG. 6 shows the high density connector of FIG. 5 along another direction.

Referring to FIGS. 5 and 6, the high density connector 1 of the present invention includes an insulating housing 10 and a wafer module 20 mounted in the insulating housing 10.

Figure 7:
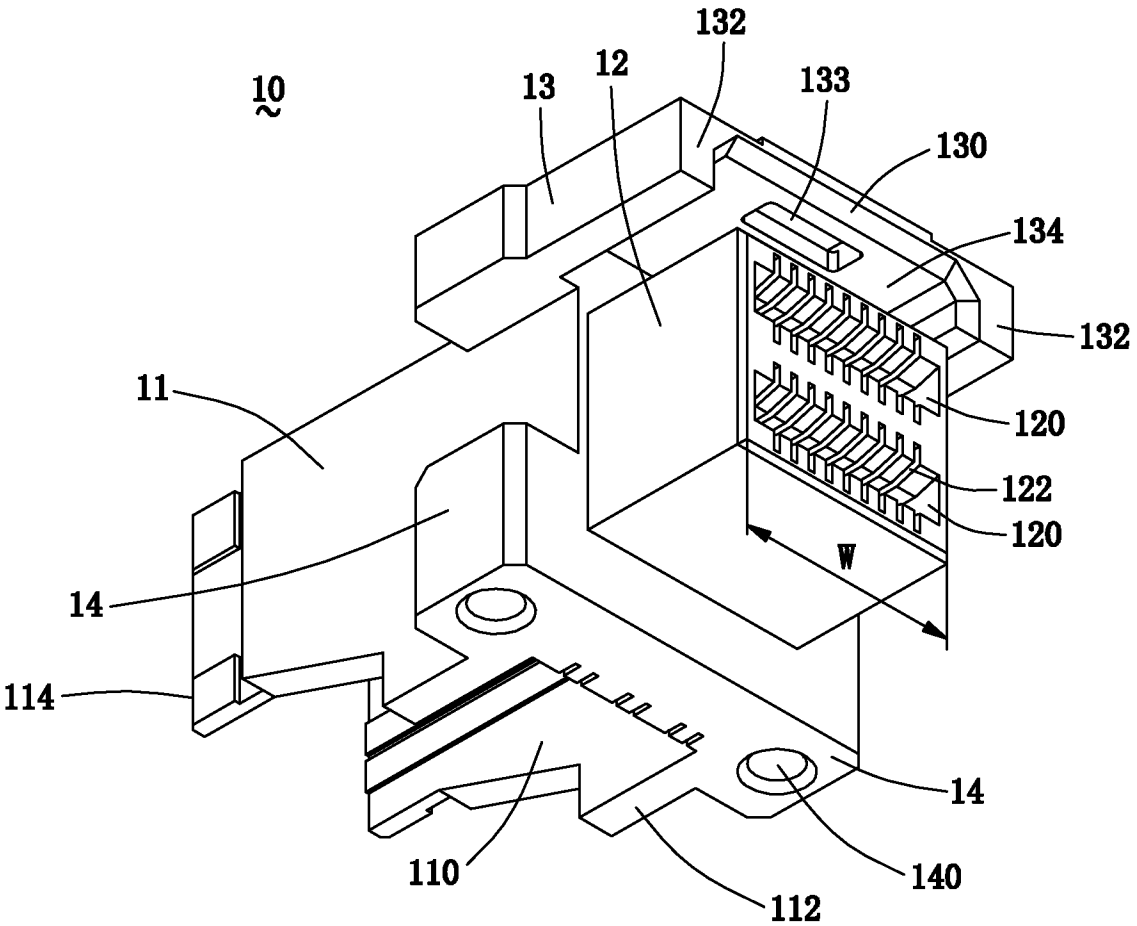
FIG. 7 is a schematic view of an insulating housing of the high density connector of the present invention.

Referring to FIGS. 5, 6 and 7, the insulating housing 10 has a base 11, a docking portion 12 extending forward from the front of the base 11, and a guide bracket 13 being formed on the top of the base 11 and extending forward above the docking portion 12. As shown in FIGS. 6 and 7, the base 11 forms a cavity 110 for receiving the wafer module 20. Specifically, the base 11 has an open bottom 112 and an open rear 114 to facilitate the installation of the wafer module 20. The base 11 further has a row of holding grooves 116 being formed above the cavity 110 and extending toward the docking portion 12 for fixing the wafer module 20.

Referring to FIGS. 5 and 7, the docking portion 12 has one or more horizontal electronic card receiving slots 120 formed on the front thereof. In the embodiment, FIG. 5 shows two parallel electronic card receiving slots 120 for receiving the electronic cards or printed circuit cards (not shown) to be inserted. Each electronic card receiving slot 120 is provided with two rows of terminal receiving grooves 122, which are arranged respectively on two opposite sides thereof. As shown in FIG. 6, all the terminal receiving grooves 122 are communicated with the cavity 110 of the base 11.

Referring to FIGS. 5 and 7, the guide bracket 13 has a horizontal portion 130 being provided with a locking structure 133, and two vertical portions 132 being symmetrically located on both sides of the horizontal portion 130. The rear of the horizontal portion 130 is connected to the top of the base 11. The front of the horizontal portion 130 is located above the docking portion 12 and is at a distance from the top of the docking portion 12. A distance between the two vertical portions 132 is larger than the wide W of the docking portion 12, so the horizontal portion 130 and the two vertical portions 132 together define a guide space 134 above the docking portion 12. When a plug connector (not shown) is engaged with the high density connector 1, the guide bracket 13 can provide a guiding and locking function to limit the plug connector to a fixed position. In the embodiment, the locking structure 133 is a hole, which can be mated with a protrusion of the plug connector for fixing the plug connector. In other embodiments, the two vertical portions 132 of the guide bracket 13 can be further extended downward for forming a semi enclosed structure to the docking portion 12.

Figure 1:
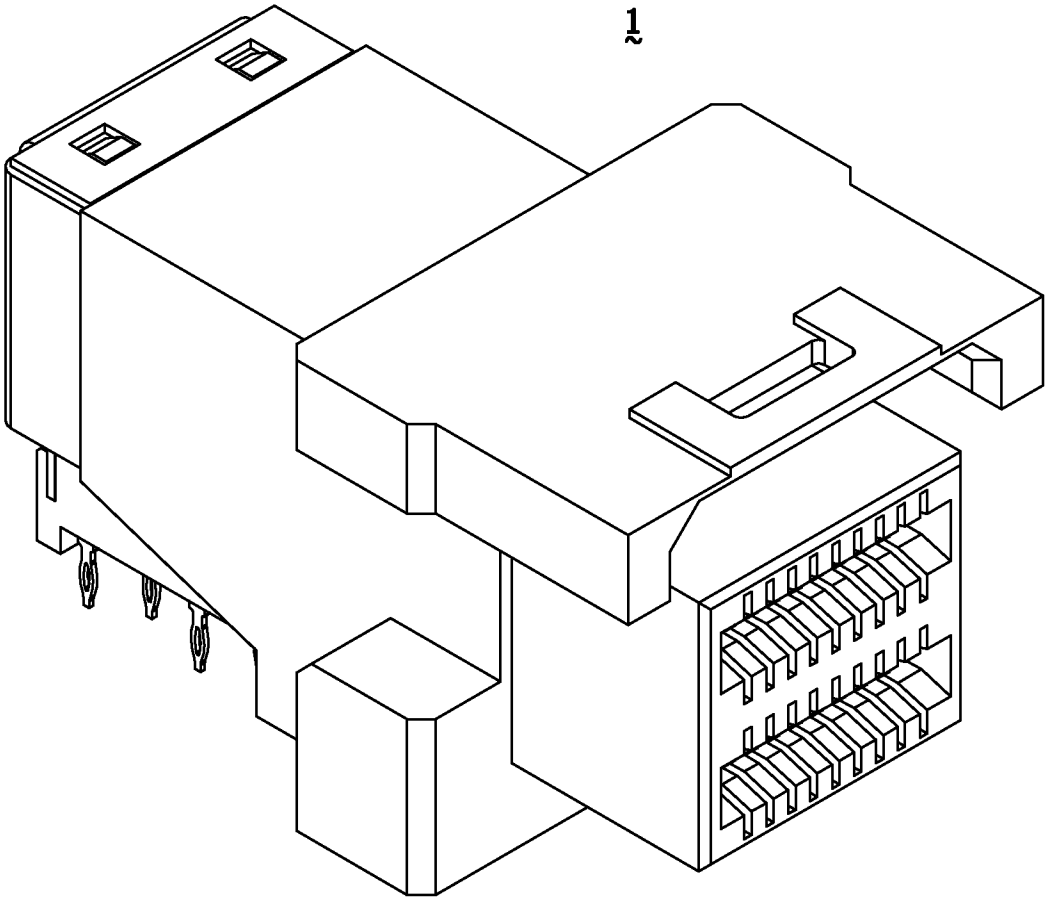
FIG. 1 is a perspective schematic view of a high density connector of the present invention.
Figure 2:
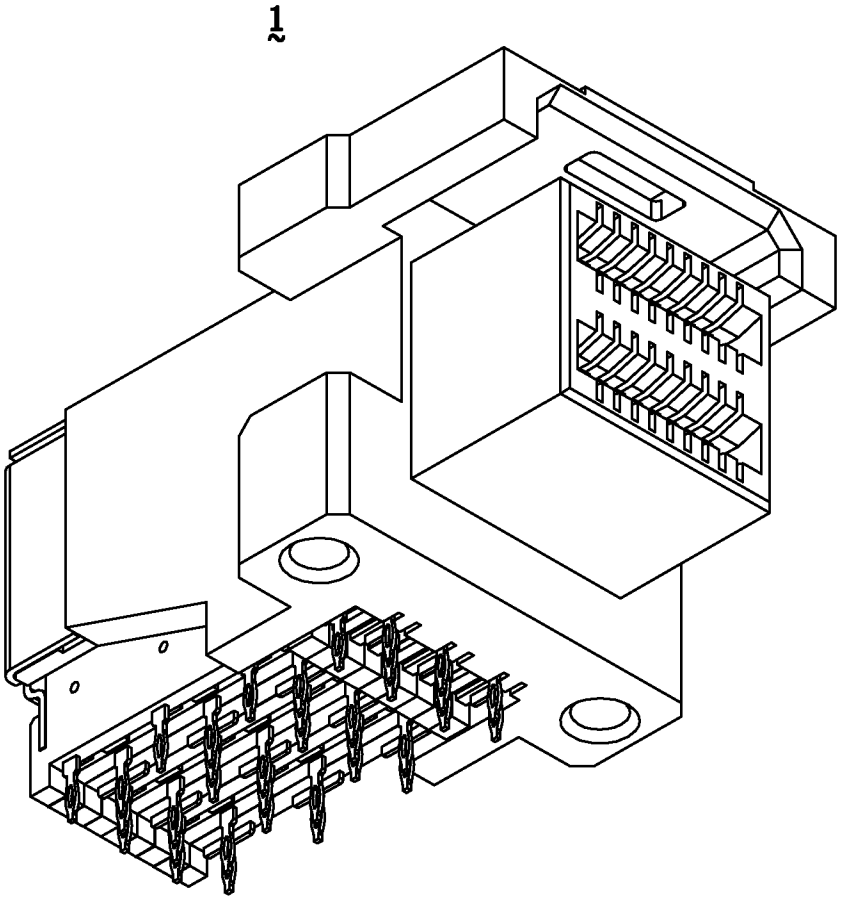
FIG. 2 is a perspective schematic view of the high density connector showing along another direction.
Figure 3:
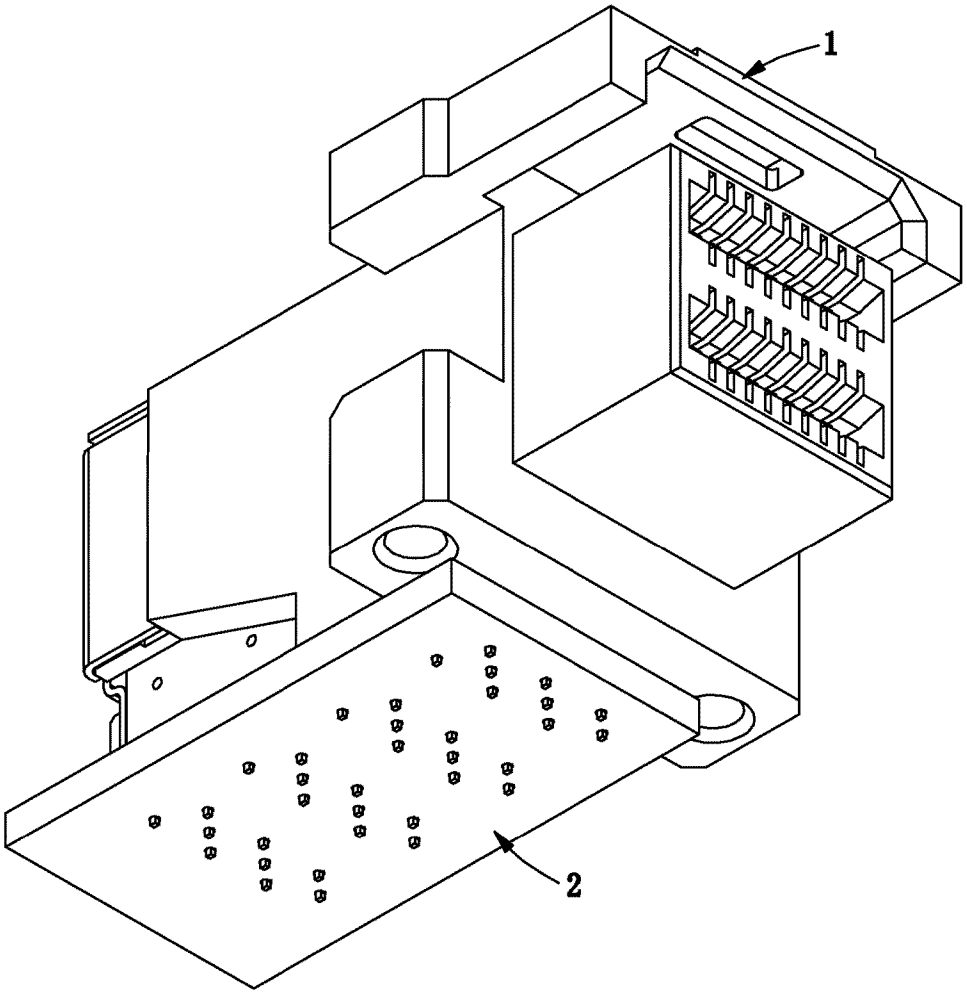
FIG. 3 is a schematic view of the high density connector mounted on a circuit board.
Figure 4:
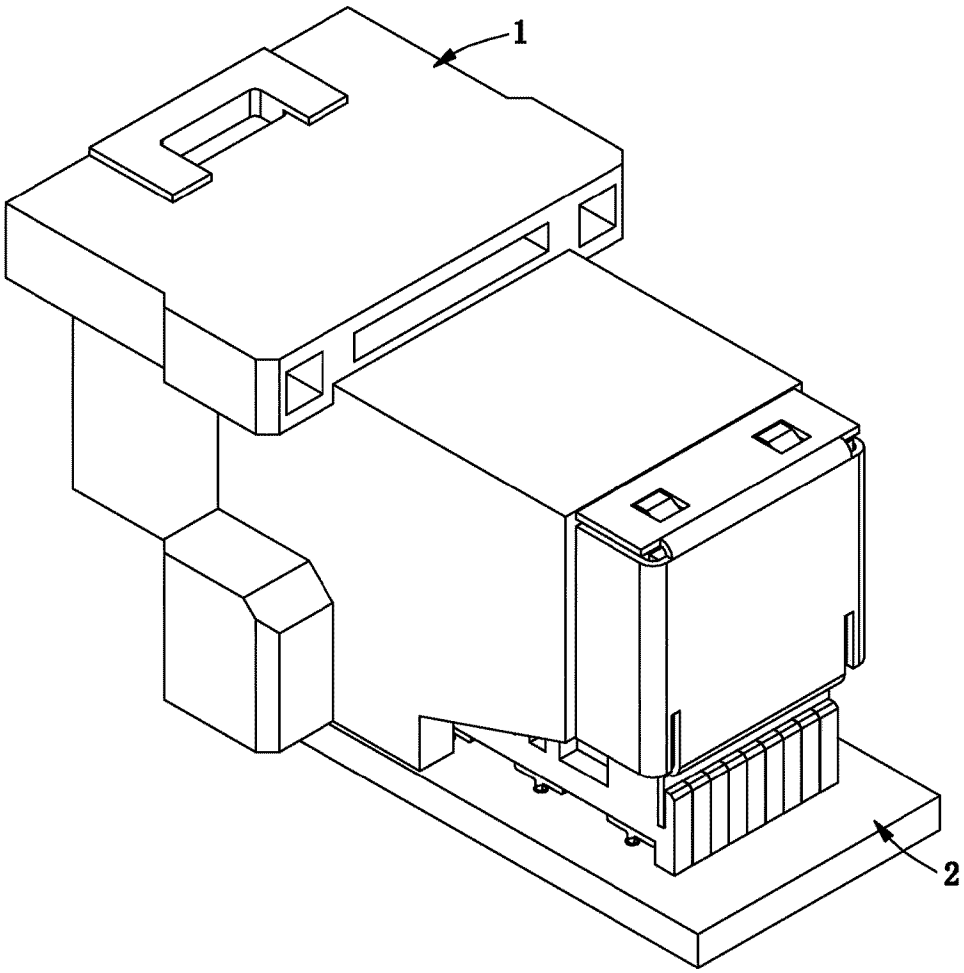
FIG. 4 shows the high density connector mounted on the circuit board along another direction.

Referring to FIGS. 5 and 7 again, the insulating housing 10 further includes two support portions 14, which are symmetrically located on two sides of the base 11 and extend vertically to the bottom of the base 11. Each support portion 14 forms a hole 140 on the bottom thereof to fix the circuit board 2 as shown in FIG. 3.

Figure 8:
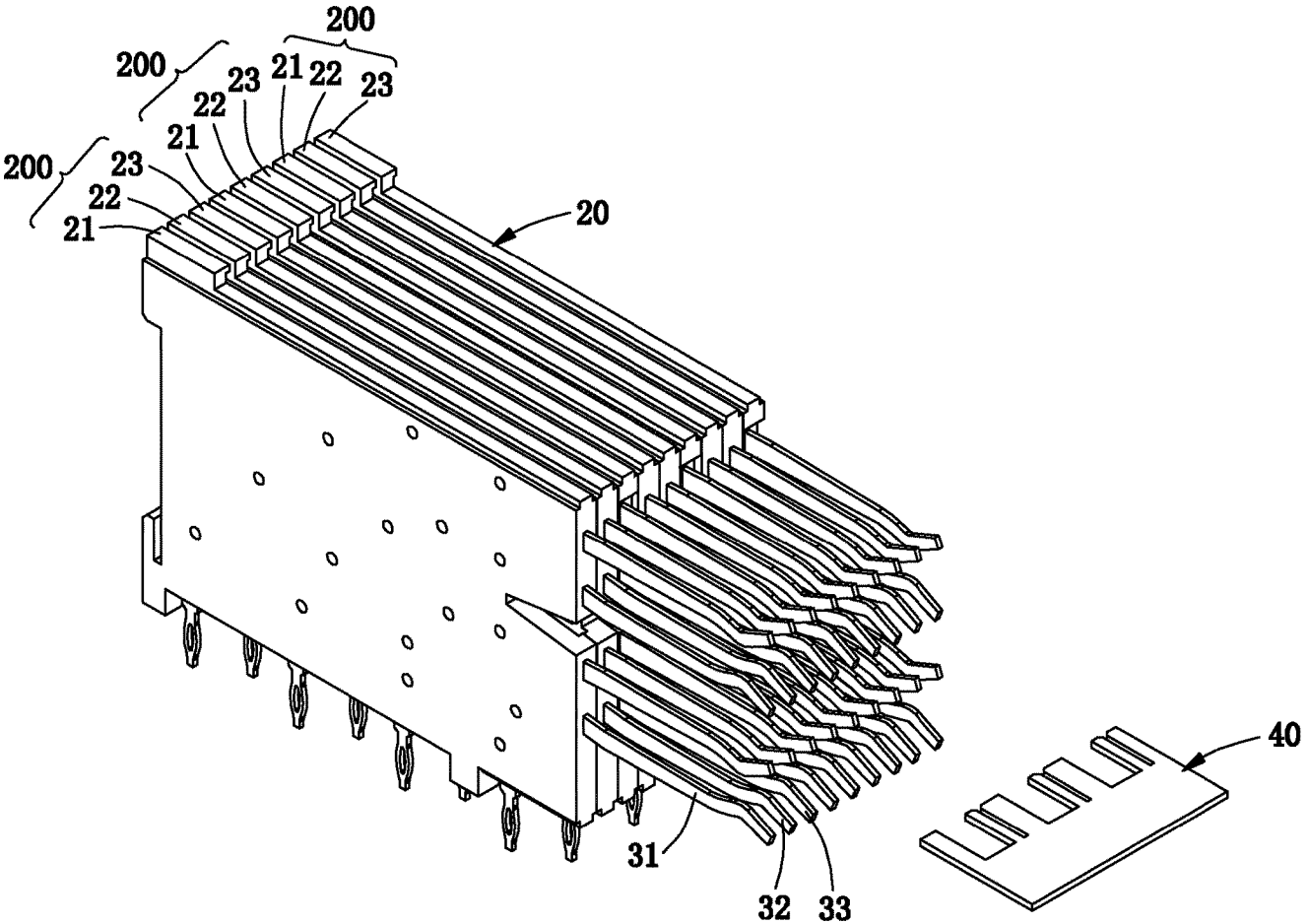
FIG. 8 is a schematic view of a wafer module and a connection sheet after disassembled.

Referring to FIG. 8, the wafer module 20 is assembled by multiple wafer groups 200 arranged side by side. Each wafer group 200 includes a first wafer 21, a second wafer 22 and a third wafer 23, which are arranged side by side in this order. The first wafer 21 is a signal wafer for supporting multiple signal terminals 31. The second wafer 22 is a signal wafer for supporting multiple signal terminals 32, too. The third wafer 23 is a ground wafer for supporting at least one ground terminal 33. The signal terminals 31, 32 and the ground terminal 33 will be described in detail bellow. It can be seen from FIG. 8 that the wafer module 20 is configured in a repetitive mode with "signal wafer"-"signal wafer"-"ground wafer". In the wafer module 20, every two adjacent signal wafers (such as the first wafer 21 and the second wafer 22) form a pair of signal wafers. The signal terminals 31 and 32 of the two adjacent signal wafers form multiple differential pairs. One ground wafer (such as the third wafer 23) is arranged between every two pairs of signal wafers.

Figure 13:
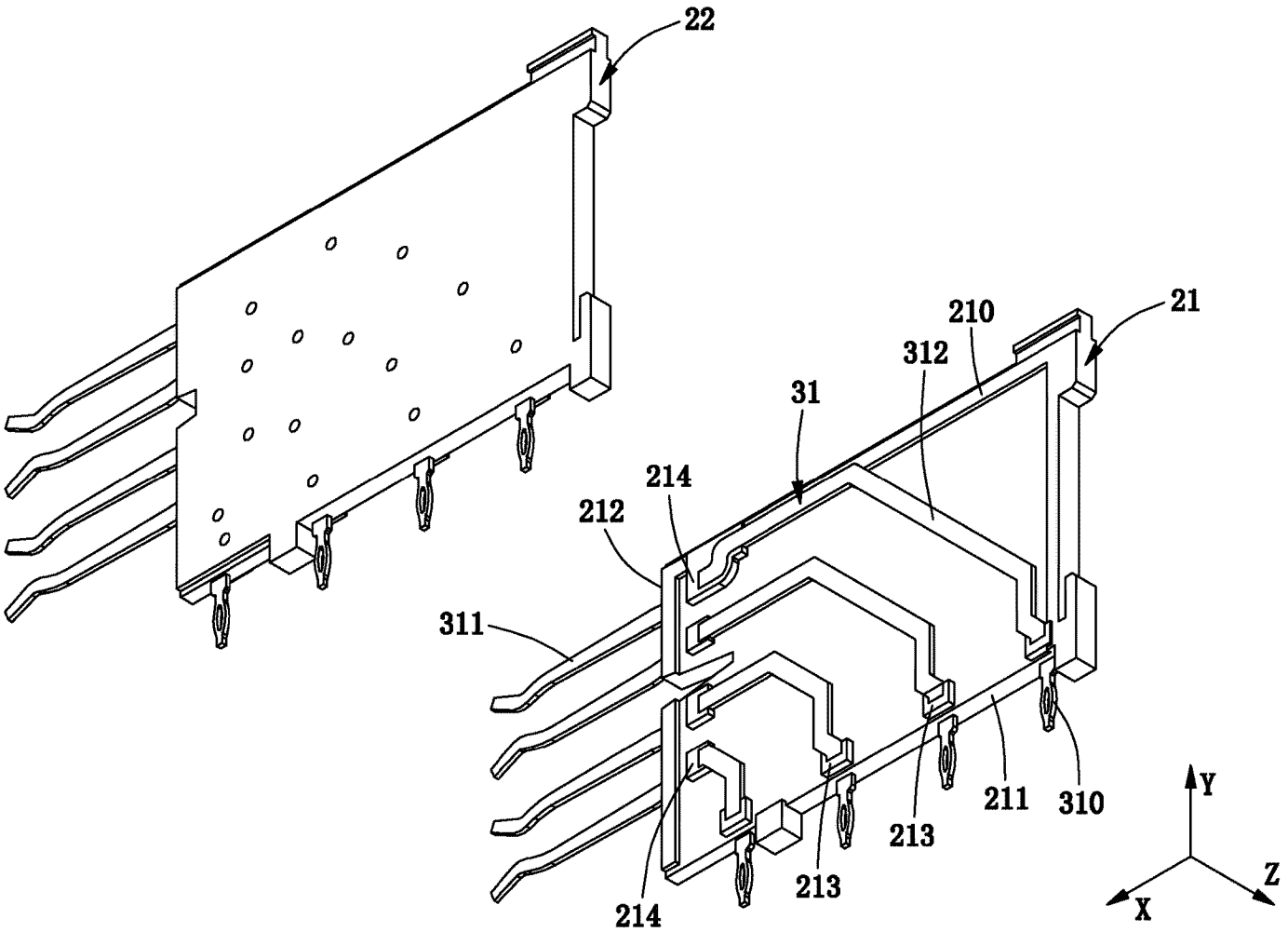
FIG. 13 shows the first wafer and the second wafer after disassembled, and mainly shows the detail structure of the first wafer.

Referring to FIG. 13, the first wafer 21 includes a first frame 210 and multiple first signal terminals 31 supported by the first frame 210. Each first signal terminal 31 has a first signal tail 310 extending out from a first edge 211 of the first frame 210, a first signal contact portion 311 extending out from a second edge 212 of the first frame 210, and a first middle portion 312 between the first signal tail 310 and the first signal contact portion 311. The first middle portion 312 is located on one side of the first frame 210, is exposed to the air, and faces the second wafer 22. The first middle portions 312 of the first signal terminals 31 in the same first wafer 21 are located in the same vertical plane P (seen in FIGS. 14 to 17). The first signal tails 310 of the first signal terminals 31 in the same first wafer 21 are arranged in a row along X axis and are out of the vertical plane P. The first signal tails 310 can be mounted on the circuit board 2 as shown in FIG. 3. The first signal contact portion 311 of the first signal terminals 31 in the same first wafer 21 are arranged in a line along Y axis and are out of the vertical plane P. In the embodiment, the first edge 211 and the second edge 212 are adjacent and perpendicular to each other.

Figure 12:
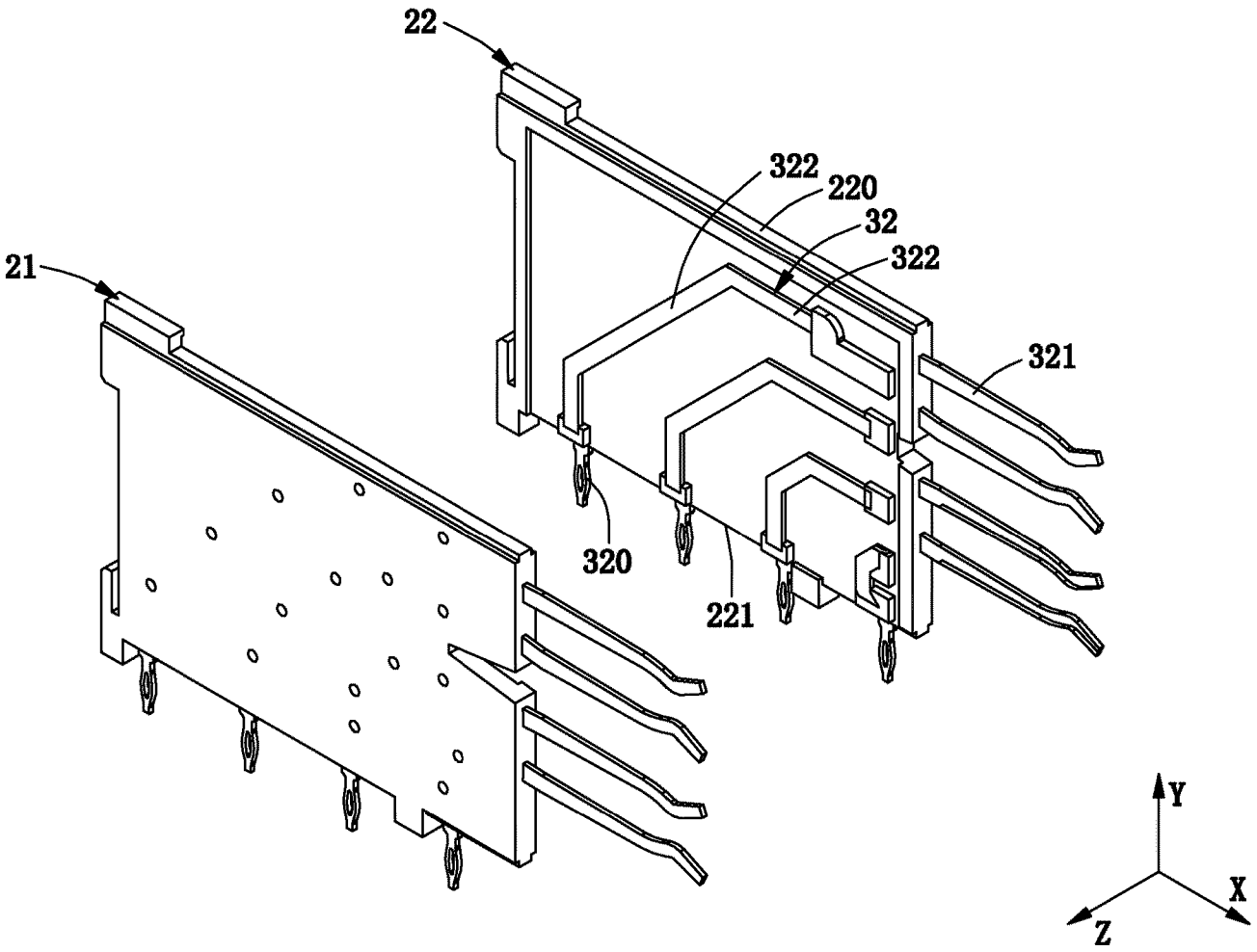
FIG. 12 is a schematic view of the first wafer and the second wafer after disassembled, and mainly shows the detail structure of the second wafer.

Referring to FIG. 12, the second wafer 22 is similar to the first wafer 21. The second wafer 22 includes a second frame 220 and multiple second signal terminals 32 supported by the second frame 220. Each second signal terminal 32 has a second signal tail 320 extending out from a first edge 221 of the second frame 220, a second signal contact portion 321 extending out from a second edge 222 of the second frame 220, and a second middle portion 322 between the second signal tail 320 and the second signal contact portion 321. The second middle portion 322 is located on one side of the second frame 220, is exposed to the air, and faces the first wafer 21. Similarly, the second middle portions 322 of the second signal terminals 32 in the same second wafer 22 are located in the same vertical plane P (seen in FIGS. 14 to 17). The second signal tails 320 of the second signal terminals 32 in the same second wafer 22 are arranged in a row along X axis and are out of the vertical plane P. The second signal contact portion 321 of the second signal terminals 32 in the same second wafer 22 are arranged in a line along Y axis and are out of the vertical plane P.

Figure 18:
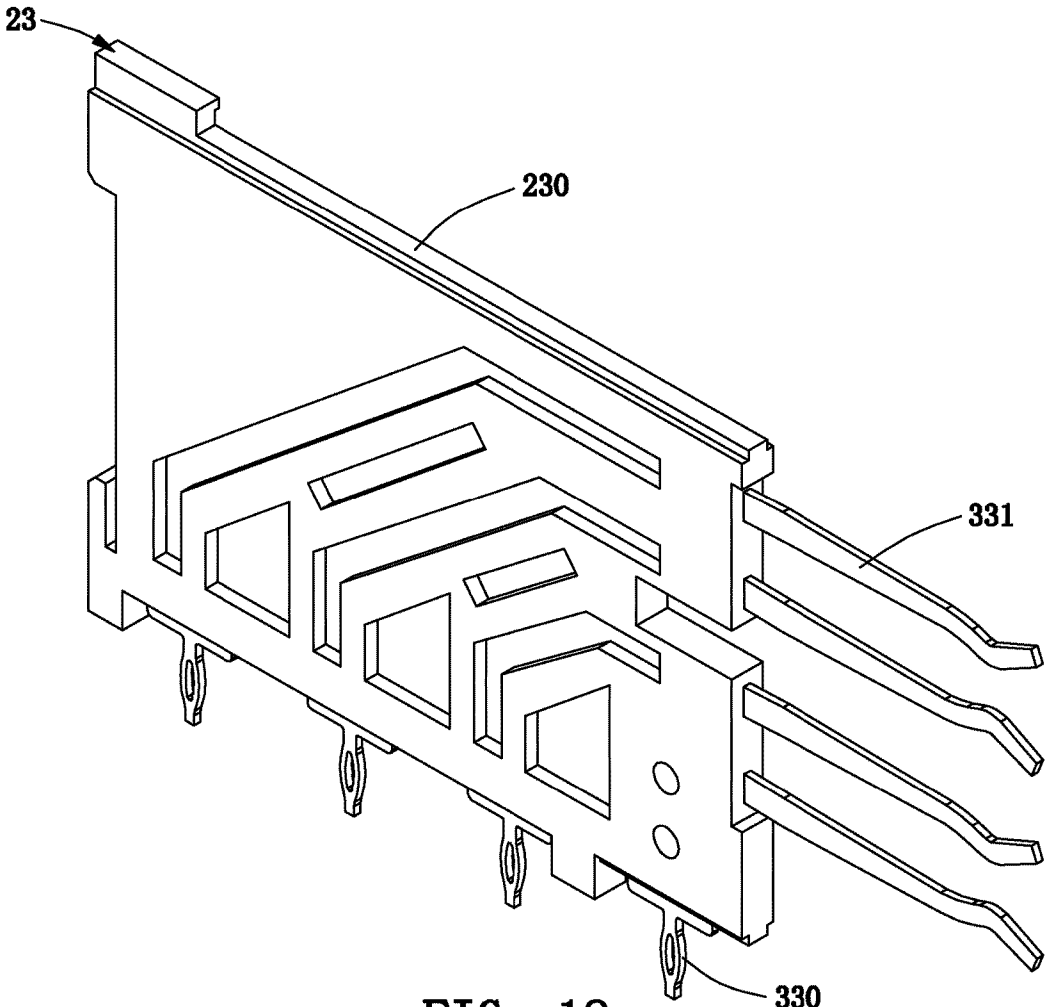
FIG. 18 is a schematic view of the third wafer of the present invention.

Referring to FIGS. 18 and 19, the third wafer 23 includes a third frame 230 and at least one ground terminal 33 supported by the third frame 230. The ground terminal 33 has a row of ground tails 330 extending out from a bottom edge of the third frame 230, a row of ground contact portions 331 extending out from a side edge of the third frame 230, and a ground main body 332 between the ground tails 330 and the ground contact portions 331.

Figure 9:
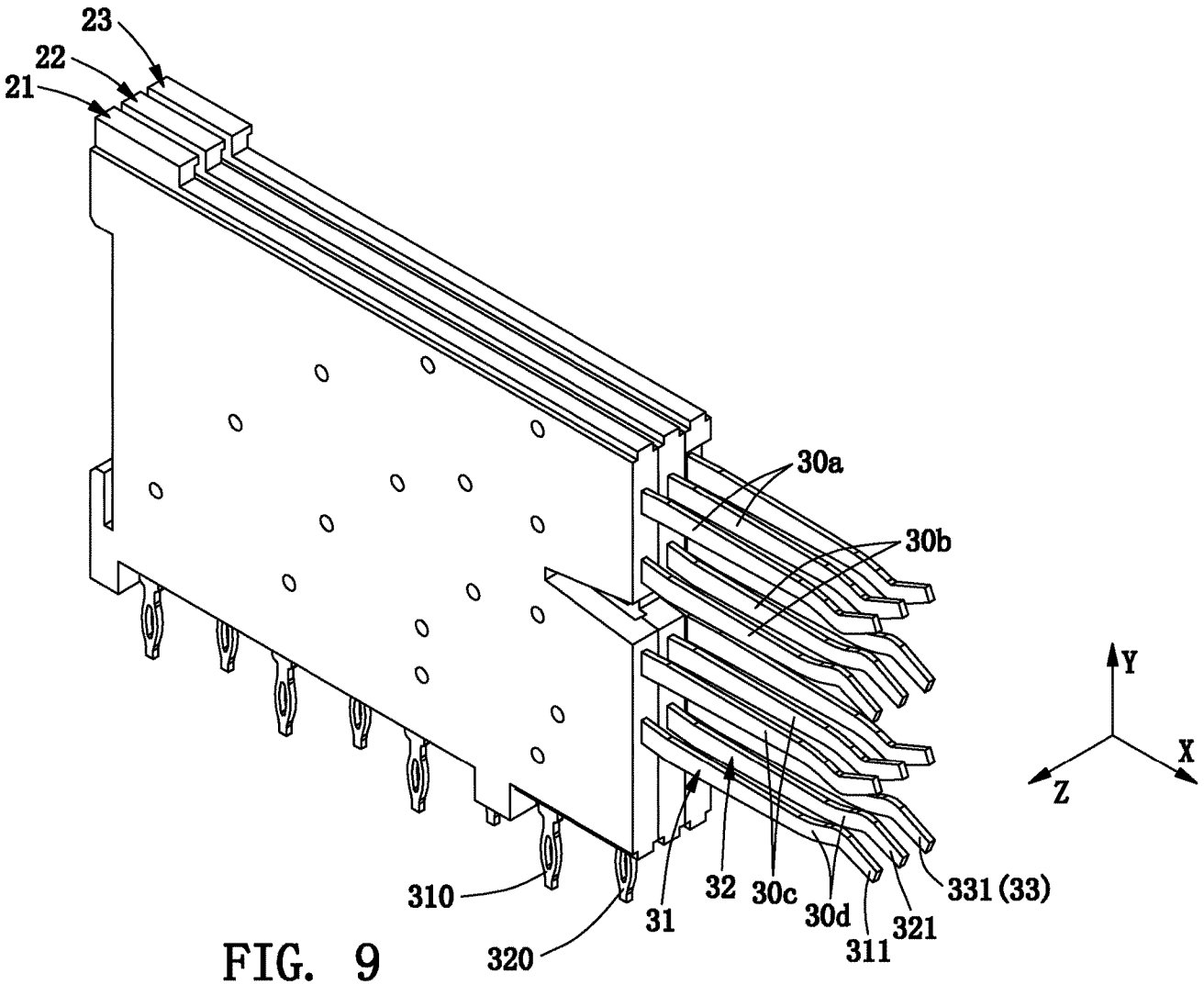
FIG. 9 is a schematic view of a first wafer, a second wafer and a third wafer after combined.

Please refer to FIG. 9, when the first wafer 21 and the second wafer 22 are arranged side by side, all the signal terminals 31, 32 located in the first wafer 21 and the second wafer 22 constitute a signal terminal assembly 30 (seen in FIG. 14) of the present invention. Each first signal terminal 31 is coupled to the corresponding second signal terminal 32 to form one edge-coupled differential pair. In the embodiment, the first wafer 21 includes four first signal terminals 31, and the second wafer 22 includes four second signal terminals 32. Therefore, when the first wafer 21 and the second wafer 22 are combined together, the first signal terminals 31 and the second signal terminals 32 thereof form four differential pairs 30*a*, 30*b*, 30*c* and 30*d*, and the middle portions 312, 322 of the first and second signal terminals 31, 32 are located in the same vertical plane P, which is shown in FIG. 14.

Figure 14:
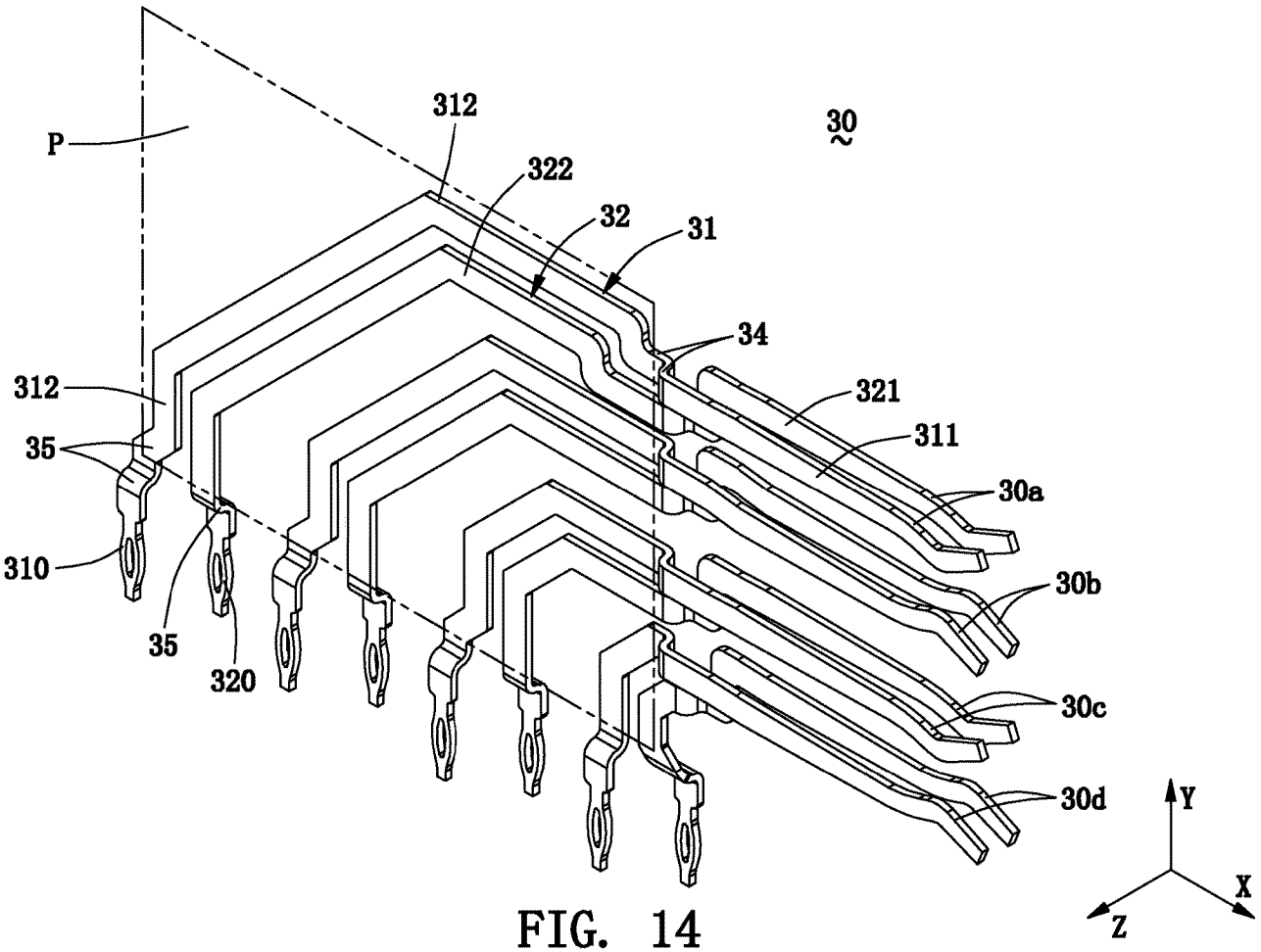
FIG. 14 is a schematic view of a signal terminal assembly of the present invention.

Please refer to FIGS. 9 and 19, when the third wafer 23 is arranged side by side with the first wafer 21 and the second wafer 22, the ground main body 332 of the ground terminal 33 is located on one side of the second wafer 22, that is, one side of the middle portions 312, 322 of the signal terminal assembly 30 (label as shown in FIG. 14). Thus, the ground main body 332 of the ground terminal 33 can cover the whole the middle portions 312, 322 of the signal terminal assembly 30 on the side of the second wafer 22 for providing a shielding function. The row of the ground contact portions 331 of the ground terminal 33 is arranged side by side with the signal contact portions 311, 321 of the signal terminal assembly 30 along Z axis. The row of the ground tails 330 (label as shown in FIG. 19) of the ground terminal 33 is extended downward with the signal tails 310, 320 of the signal terminal assembly 30 in a predetermined arrangement mode for preparing to be connected to the circuit board 2 shown in FIG. 3.

Figure 15:
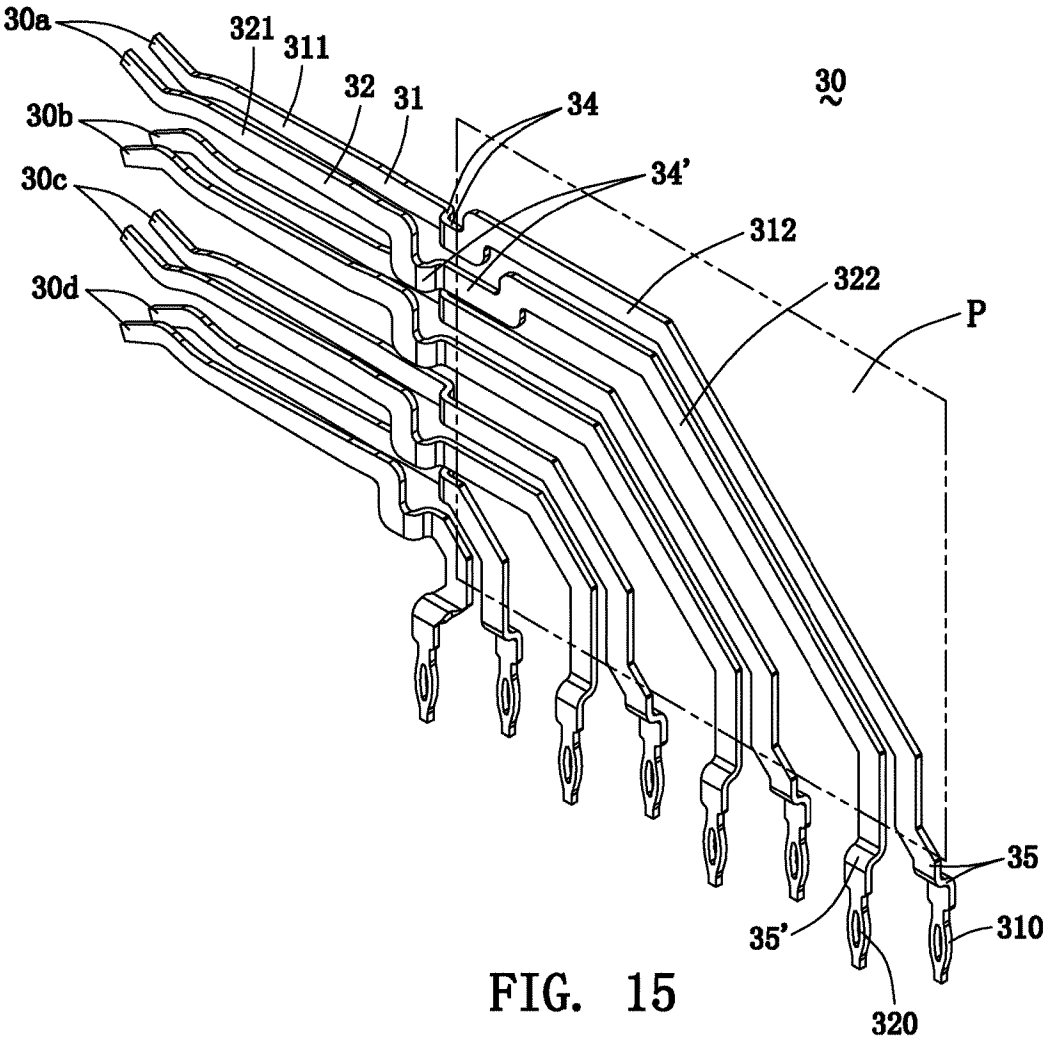
FIG. 15 shows the signal terminal assembly along another direction.

Please refer to FIGS. 14 and 15, all the first signal terminals 31 of the first wafer 21 and all the second signal terminals 32 of the second wafer 22 constitute the signal terminal assembly 30 of the present invention. In detail, the signal terminal assembly 30 includes multiple differential pairs 30*a*-30*d*. In the embodiment, the signal terminal assembly 30 includes four differential pairs 30*a*-30*d*.

The following text will take one differential pair 30*a* as an example to introduce the detailed structure of the signal terminals.

Referring to FIG. 14, in the differential pair 30*a*, the first middle portion 312 of the first signal terminal 31 and the second middle portion 322 of the second signal terminal 32 are located in the same vertical plane P, and the first middle portion 312 and the second middle portion 322 are configured to be coupled together in an edge-coupled manner for reducing the loss, which can be produced by capacitance coupling effect existed in a wide-coupled manner of the prior art. At least one of the first and second signal contact portions 311, 321 is located out of the vertical plane P to make the first and second signal contact portions 311, 321 be arranged in parallel along Z axis and form a wide side to wide side mode. Further, at least one of the first and second signal tails 310, 320 is located out of the vertical plane P to make the first and second signal tails 310, 320 be staggered along X axis and Z axis. That is, the first and second signal tails 310, 320 are not coplanar or coaxial. The first and second middle portions 312, 322 are generally L-shaped.

Figure 17:
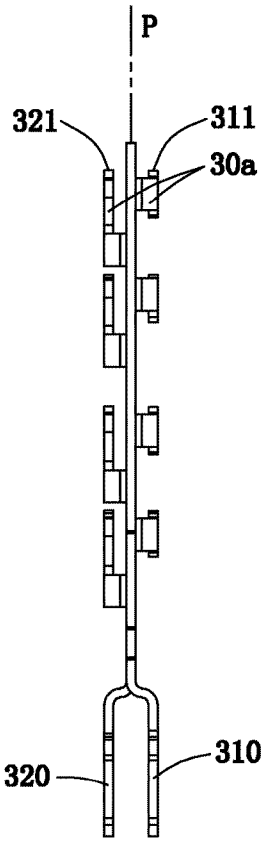
FIG. 17 is a side view of the signal terminal assembly of FIG. 15.

Referring to FIGS. 14, 15 and 17, in the embodiment, the first and second signal contact portions 311, 321 in the same differential pair (such as 30*a*) are out of the vertical plane P along opposite directions. For example, the first signal contact portion 311 is offset toward one side of the vertical plane P, and the second signal contact portion 321 is offset toward the other side of the vertical plane P. Further, each of the signal terminals 31, 32 has one special structure, which can adjust the positions and the spacing of the first and second signal contact portions 311, 321, and can make the first and second signal contact portions 311, 321 be a parallel structure in the wide side to wide side mode.

Referring to FIGS. 14, 15 and 17, in the embodiment, the first and second signal tails 310, 320 in the same differential pair (such as 30*a*) are also out of the vertical plane P along the opposite directions. For example, the first signal tail 310 is offset toward one side of the vertical plane P, and the second signal tail 320 is offset toward the other side of the vertical plane P. Each of the signal terminals 31, 32 has the other special structure, which can adjust the positions and the spacing of the first and second signal tails 310, 320, and can make the first and second signal tails 310, 320 be in accordance with the arrangement mode of conducting through holes of the circuit board 2 shown in FIG. 3.

Figure 16:
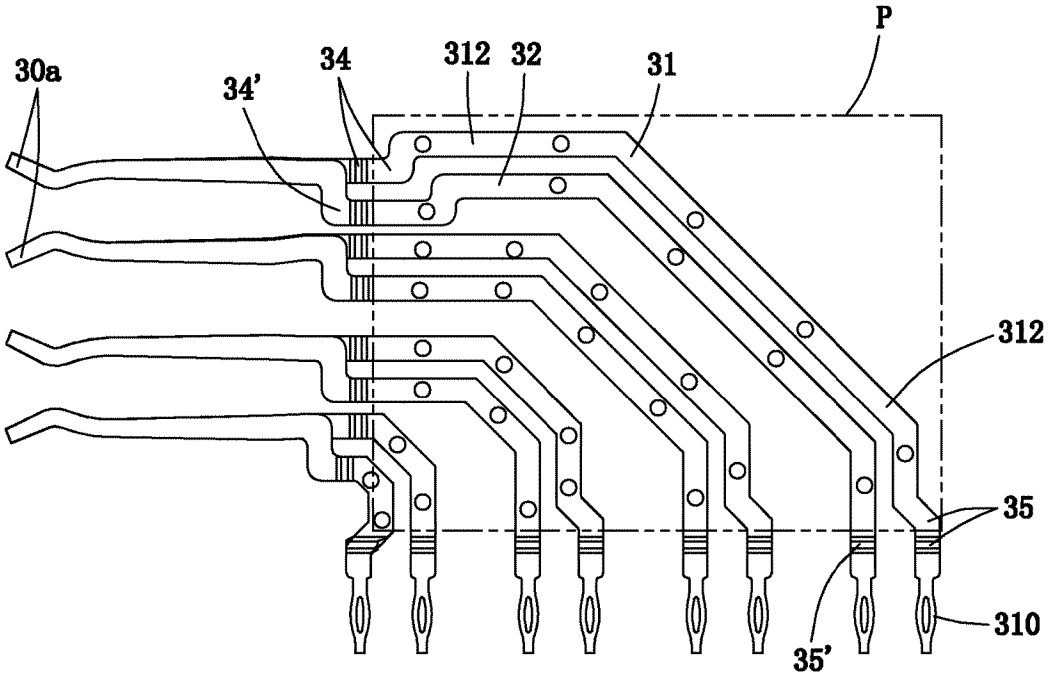
FIG. 16 is a plan view of the signal terminal assembly of FIG. 15.

More specifically, please refer to FIGS. 14, 15 and 16, in the embodiment, the so-called special structures refer to a head-adjusting structure 34 and a tail-adjusting structure 35. Namely, in each differential pair (such as 30*a*), each signal terminal 31(32) further includes one head-adjusting structure 34(34') and one tail-adjusting structure 35(35'). For example, the head-adjusting structure 34(34') of the first signal terminal 31 is located between the first middle portion 312 and the first signal contact portion 311 for changing the relative position of the first signal contact portion 311 and the first middle portion 312 and making the first signal contact portion 311 be out of the vertical plane P of the first middle portion 312. The tail-adjusting structure 35 is located between the first middle portion 312 and the first signal tail 310 for changing the relative position of the first signal tail 310 and the first middle portion 312 and making the first signal tail 310 be out of the vertical plane P of the first middle portion 312. Similarly, the second signal terminal 32 can change the positions of the second signal contact portion 321 and the second signal tail 320 by the head-adjusting structure 34' and the tail-adjusting structure 35'.

In the embodiment, the position of the signal contact portion 311(321) of each signal terminal 31(32) can be adjusted by the head-adjusting structure 34(34'), and the position of the signal tail 310(320) thereof can be adjusted by the tail-adjusting structure 35(35'). But in other embodiments, only some signal terminals 31(32) dispose the head-adjusting structure 34(34') and/or the tail-adjusting structure 35(35'), as required. This can also make two signal contact portions 311(321) of each differential pair be arranged in parallel along Z axis, and make two signal tails 310(320) be staggered along X axis and Z axis.

In the embodiment, referring to FIGS. 14 and 15, the head-adjusting structure 34(34') and the tail-adjusting structure 35(35') can be one or more extension parts formed by stamping and extending downward or upward or obliquely, and can also be one or more bending parts formed by bending to the left or right, and can be a combination of the extension parts and the bending parts. In fact, all the adjusting structures are mainly used to ensure that the middle portions 312, 322 of the first and second signal terminals 31, 32 in the same differential pair can be coupled in the edge-coupled manner, and the signal contact portions 311, 321 can be mated with a complementary connector, and the signal tails 310, 320 can be arranged in a certain mode for being electrically connected to the circuit board.

Please refer to FIG. 13, in the first wafer 21, the first frame 210 further has at least one first block 213 adjacent to the first edge 211, and at least one second block 214 adjacent to the second edge 212. In this embodiment, the first frame 210 has a row of the first blocks 213 disposed along the first edge 211 and a row of the second blocks 214 disposed along the second edge 212. At least one part of the tail-adjusting structure 35 of each first signal terminal 31 is embedded in the corresponding first block 213, and at least one part of the head-adjusting structure 34 is embedded in the corresponding second block 214. Similarly, as shown in FIG. 12, the second frame 220 of the second wafer 22 also has basically the same blocks as the first frame 210. Furthermore, the number of the first and second blocks 213, 214 is determined according to the number of the first signal terminals 31.

Figure 11:
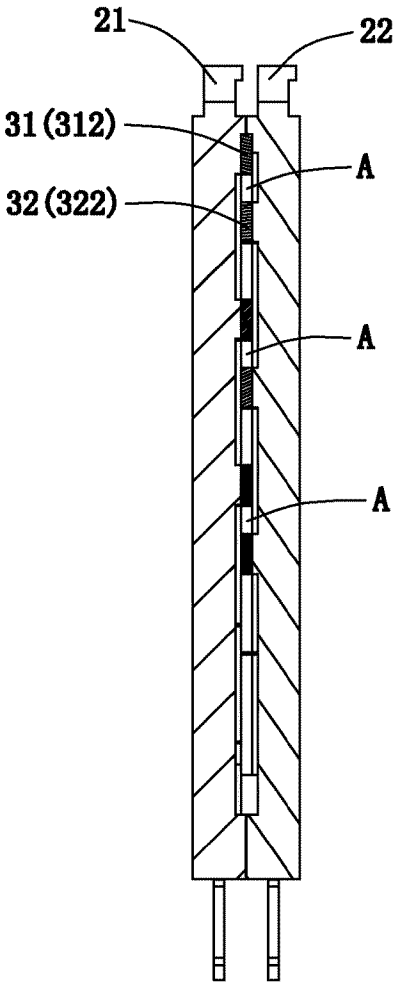
FIG. 11 shows a sectional structure of the first wafer and the second wafer along an 0-0 line in FIG. 10.
Figure 10:
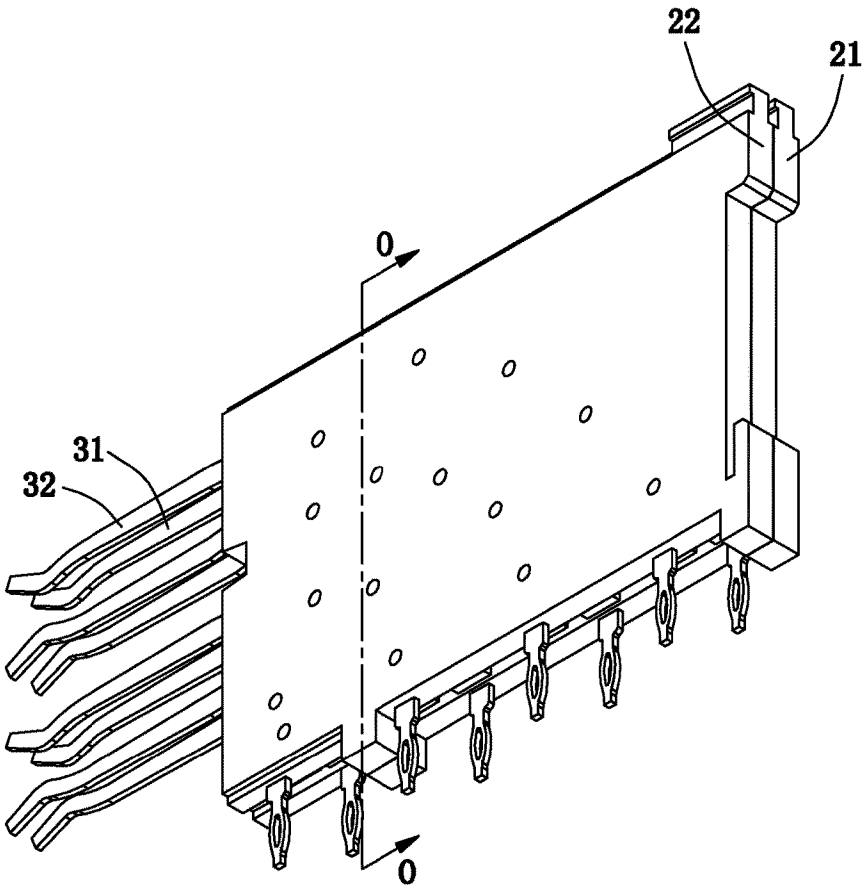
FIG. 10 is a schematic view of the first wafer and the second wafer after combined.

The wafer 21(22) of the present invention can greatly reduce the thickness of the frame 210(220) by setting the blocks 213, 214 to expose the middle portion 312(322) of the signal terminals 31(32) fully. Moreover, the blocks 213, 214 can further provide certain structural strength to fix the signal terminals 31(32). Referring to FIGS. 9, 10 and 11, when the first wafer 21 and the second wafer 22 are combined together, in each differential pair, the middle portions 312, 322 of the first signal terminal 31 and the second signal terminal 32 can be coupled in the edge-coupled manner. In addition, air (A) is used as a medium between the middle portions 312, 322 to further reduce the loss of signal transmission.

Please refer to FIG. 8, all the wafers 21, 22 and 23 can be combined together to form a complete wafer module 20 by a connection sheet 40.

When assembling, as shown in FIG. 6, the front of the wafer module 20 is inserted into the cavity 110 along the holding grooves 116 of the insulating housing 10. The front ends (such as the signal contact portions and the ground contact portions) of all the terminals are inserted into the corresponding terminal receiving grooves 122 and are exposed into the corresponding electronic card receiving slots 120 for preparing to be engaged with electronic cards to be inserted. The tails (such as the signal tails and the ground tails) of all the terminals are extending out from the open bottom 112 of the insulating housing 10 for preparing to be connected to the circuit board 2 of FIG. 3. Finally, the wafer module 20 is fixed in the insulating housing 10 by a retaining member 60 shown in FIGS. 5 and 6.

As described above, the high density connector 1 of the present invention can provide a guiding and locking function for the plug connector by the guide bracket 13 formed on the insulating housing 10. All the signal terminals 31, 32 of the high density connector 1 are configured to be multiple edge-coupled differential pairs for reducing the loss of signal transmission and improving the quality of differential signal transmission. The wafer group 200 of the present invention includes two signal wafers 21, 22, the signal terminals 31, 32 of which are configured to be differential pairs and have the middle portions 312, 322 exposed outside. In each differential pair, the middle portions 312, 322 are designed to be edge-coupled through air for reducing the loss of signal transmission and improving the quality of differential signal transmission. The signal terminal assembly 30 of the present invention includes the first and second terminals 31, 32, which are configured to be edge-coupled differential pairs, to reduce the loss of signal transmission and improve the quality of differential signal transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high density connector, comprising:

an insulating housing having a base, a docking portion extending forward from the front of the base, and a guide bracket being formed on the top of the base and extending forward above the docking portion; the base forming a cavity; the docking portion having at least one electronic card receiving slot formed on the front thereof and two rows of terminal receiving grooves arranged on two opposite sides of the electronic card receiving slot respectively; and all the terminal receiving grooves being communicated with the cavity; and a wafer module being mounted in the cavity of the insulating housing and being assembled by multiple wafer groups arranged side by side; each wafer group including a first wafer, a second wafer and a third wafer, which are arranged side by side in this order; the first and second wafers being signal wafers for supporting multiple signal terminals; and the third wafer being a ground wafer for supporting at least one ground terminal;

wherein the wafer module is configured in a repetitive mode with "signal wafer"-"signal wafer"-"ground wafer", every two adjacent signal wafers form a pair of signal wafers, and the signal terminals of the two adjacent signal wafers form multiple edge-coupled differential pairs.

2. The high density connector as claimed in claim 1, wherein the guide bracket has a horizontal portion being provided with a locking structure and two vertical portions being symmetrically located on both sides of the horizontal portion; the rear of the horizontal portion is connected to the top of the base; the front of the horizontal portion is located above the docking portion; and the horizontal portion and the two vertical portions together define a guide space above the docking portion.

3. The high density connector as claimed in claim 2, wherein the insulating housing further includes two support portions, which are symmetrically located on two sides of the base and extend vertically to the bottom of the base; the two support portions are located under the two vertical portions; and each support portion forms a hole on the bottom thereof.

4. The high density connector as claimed in claim 1, wherein the first wafer includes a first frame and multiple first signal terminals supported by the first frame; each first signal terminal has a first signal tail extending out from a first edge of the first frame, a first signal contact portion extending out from a second edge of the first frame, and a first middle portion being located between the first signal tail and the first signal contact portion; the first middle portion is located on one side of the first frame, exposed to the air, and faces the second wafer; and the second wafer includes a second frame and multiple second signal terminals supported by the second frame; each second signal terminal has a second signal tail extending out from a first edge of the second frame, a second signal contact portion extending out from a second edge of the second frame, and a second middle portion being located between the second signal tail and the second signal contact portion; the second middle portion is located on one side of the second frame, exposed to the air, and faces the first wafer;

wherein the first middle portions of the first signal terminals and the second middle portions of the second signal terminals are located in one vertical plane; each first middle portion is configured to be coupled with the corresponding second middle portion in an edge-coupled manner for making the first signal terminal and the corresponding second signal terminal form one differential pair.

5. The high density connector as claimed in claim 4, wherein the third wafer includes a third frame and at least one ground terminal supported by the third frame; the ground terminal has a row of ground tails extending out from the bottom of the third frame, a row of ground contact portions extending out from the side of the third frame, and a ground main body between the ground tails and the ground contact portions; the ground main body is located on one side of the second wafer to cover the first and second middle portions in the first and second wafers.

6. The high density connector as claimed in claim 4, wherein in each differential pair, at least one of the first and second signal contact portions employs one special structure to be out of the vertical plane, and the first and second signal contact portions are arranged in parallel and form a wide side to wide side mode; at least one of the first and second signal tails employs the other special structure to be out of the vertical plane, and the first and second signal tails are arranged in a staggered manner and are not coplanar or coaxial.

7. The high density connector as claimed in claim 6, wherein in each differential pair, the first and second signal contact portions are out of the vertical plane along opposite directions, and the first and second signal tails are also out of the vertical plane along the opposite directions.

8. A wafer group, comprising:

a first wafer being a signal wafer, which includes a first frame and multiple first signal terminals supported by the first frame; each first signal terminal having a first signal tail extending out from a first edge of the first frame, a first signal contact portion extending out from a second edge of the first frame, and a first middle portion being located between the first signal tail and the first signal contact portion;

a second wafer being a signal wafer, which includes a second frame and multiple second signal terminals supported by the second frame; each second signal terminal having a second signal tail extending out from a first edge of the second frame, a second signal contact portion extending out from a second edge of the second frame, and a second middle portion being located between the second signal tail and the second signal contact portion; and a third wafer being a ground wafer, which includes a third frame and at least one ground terminal supported by the third frame; the ground terminal having a row of ground tails extending out from the bottom of the third frame, a row of ground contact portions extending out from the side of the third frame, and a ground main body between the ground tails and the ground contact portions; the ground main body being located on one side of the second wafer to cover the first and second middle portions in the first and second wafers;

wherein the first wafer, the second wafer and the third wafer are arranged side by side in this order; the first middle portions of the first signal terminals and the second middle portions of the second signal terminals are located in one vertical plane and exposed to the air; and each second middle portion is coupled with the corresponding first middle portion in an edge-coupled manner to make the first signal terminal and the corresponding second signal terminal form one edge-coupled differential pair.

9. The wafer group as claimed in claim 8, wherein in each differential pair, at least one of the first and second signal contact portions is out of the vertical plane, and the first and second signal contact portions are arranged in parallel and form a wide side to wide side mode; and at least one of the first and second signal tails is out of the vertical plane, and the first and second signal tails are arranged in a staggered manner and are not coplanar or coaxial.

10. The wafer group as claimed in claim 9, wherein each first signal terminal further includes one head-adjusting structure and one tail-adjusting structure, the head-adjusting structure is located between the first middle portion and the first signal contact portion to change the relative position of the first signal contact portion and the first middle portion and to make the first signal contact portion be out of the vertical plane of the first middle portion; and the tail-adjusting structure is located between the first middle portion and the first signal tail to change the relative position of the first signal tail and the first middle portion and to make the first signal tail be out of the vertical plane of the first middle portion; and each second signal terminal also includes one head-adjusting structure located between the second middle portion and the second signal contact portion and one tail-adjusting structure located between the second middle portion and the second signal tail.

* * * * *